US005660303A

United States Patent [19]

Hirose

[11] Patent Number: 5,660,303

[45] Date of Patent: Aug. 26, 1997

[54] PLASTIC CASE FOR PHOTOGRAPHIC FILM CASSETTE

[75] Inventor: Masuhiko Hirose, Kanagawa, Japan

[73] Assignee: Fuji Photo Film Co., Ltd., Kanagawa, Japan

[21] Appl. No.: 324,983

[22] Filed: Oct. 18, 1994

[30] Foreign Application Priority Data

Oct. 18, 1993 [JP] Japan ..... 5-259780

[51] Int. Cl.[6] ..... B65D 41/18

[52] U.S. Cl. ..... 220/791; 206/407; 206/455; 220/780; 220/789

[58] Field of Search ..... 220/307, 8, DIG. 13, 220/780, 789, 791; 206/455, 389, 407; 215/321

[56] References Cited

U.S. PATENT DOCUMENTS

| | | | |
|---|---|---|---|
| D. 141,182 | 5/1945 | Levinger | 220/DIG. 13 X |
| 4,351,447 | 9/1982 | Graff | 220/306 |
| 4,535,889 | 8/1985 | Terauds | 220/307 |
| 4,560,083 | 12/1985 | Danico | 220/307 |
| 4,640,435 | 2/1987 | Dutt | 220/307 |
| 4,715,496 | 12/1987 | Hackman | 206/581 X |
| 4,784,285 | 11/1988 | Patel | 220/307 |
| 4,799,602 | 1/1989 | Collins et al. | 220/307 |
| 4,844,961 | 7/1989 | Akao | 206/407 X |
| 4,930,644 | 6/1990 | Robbins, III | 220/8 X |
| 4,960,626 | 10/1990 | Akao et al. | 206/407 X |
| 4,969,581 | 11/1990 | Seifert et al. | 220/307 X |
| 5,069,357 | 12/1991 | Anderson | 220/307 |
| 5,106,665 | 4/1992 | Akao et al. | 206/407 X |
| 5,139,164 | 8/1992 | Stewart | 275/321 X |
| 5,368,178 | 11/1994 | Town et al. | 220/356 X |

FOREIGN PATENT DOCUMENTS

| | | |
|---|---|---|
| 3176371 | 7/1991 | Japan . |
| 348581 | 10/1991 | Japan . |
| 5127317 | 5/1993 | Japan . |
| 5150402 | 6/1993 | Japan . |
| 6/27593 | 2/1994 | Japan . |
| 6222512 | 8/1994 | Japan . |

*Primary Examiner*—Stephen P. Garbe

*Attorney, Agent, or Firm*—Sughrue, Mion, Zinn, Macpeak & Seas

[57] ABSTRACT

A plastic case for protecting a photographic film cassette from moisture consists of a case body having a closed bottom and a lid to be fitted to an open top of the case body. The case body has a horizontal contour at least in its engaging portion with the lid, that is constituted of at least four arcs connected in series to one another, of which at least two arcs are different in radius from each other.

12 Claims, 8 Drawing Sheets

PLASTIC CASE FOR PHOTOGRAPHIC FILM CASSETTE

BACKGROUND OF THE INVENTION

1. Field of the Invention

The present invention relates to a plastic case for a photographic film cassette, especially for a photographic film cassette having a port portion protruding radially outward from the peripheral surface of a cylindrical cassette shell.

2. Related Art

In a conventional ISO 135-type photographic film cassette, a roll of photographic film is contained in a cassette shell made of a metal sheet. The ISO 135 photographic film cassette is encased in a plastic case made especially for keeping the photographic film cassette and, thereafter, packed in a rectangular box (e.g., a cardboard box) for sale.

The conventional plastic case for the photographic film cassette is constituted of a case body having a closed bottom and a lid for tightly closing an open top of the case body. The case body and the lid are each formed from resins. The plastic case is intended to protect the photographic film from moisture, and is thus required to have a high moisture resistance or a low moisture permeability of not more than 5 to 10 mg/24 hours. Since the conventional photographic film cassette is substantially cylindrical except for a port portion forming a film passageway which protrudes slightly from the peripheral surface of the cassette shell, the conventional plastic case also has a fundamentally circular horizontal contour. Because tight-fitness of engagement between two plastic parts can be kept better in curves than straight portions, it has been relatively easy to tightly seal the conventional regular cylindrical plastic case by fitting the lid to the open top of the case body.

On the other hand, photographic film cassettes are disclosed, for example, in Japanese Patent Application Nos. 5-127317 and 5-150402, whose cassette shell is constituted of elements made from resins, and which can wind the entire length of photographic film thereinto and advance the film leader to the outside by rotating the spool of the cassette. This type of photographic film cassette has a different contour from conventional ones, as is shown, for example, in FIG. 16. This is mainly because the new type photographic film cassette 110 needs to have an elongated port portion 110*b* for shielding the photographic film from ambient light entering through a film passageway 110*a*, and also enabling the film leader to be advanced to the outside through the film passageway 110*a*.

Since the new type photographic film cassette does not have a regular cylindrical contour, larger unused spaces 120*a* and 120*b* would result if the new type photographic film cassette 110 is encased in the conventional regular cylindrical plastic case 120. That is, space efficiency of the plastic case would be low.

For the above described and other reasons, there have been known various shapes of cases for photographic film cassette. For example, Japanese Patent Application No. 3-176371 discloses rectangular and semi-cylindrical cases, for indicating the conditions of the photographic film encased therein, e.g., as to whether the photographic film has been exposed or not. Also, Japanese Utility Model Publication No. 3-48581 discloses a case having an oblong horizontal contour so as to hold a couple of photographic film cassettes therein.

However, because either of the above-mentioned known cases for the photograph film cassette includes at least a straight portion in their horizontal contour, and gaps tend to form more frequently in the straight portion than the curved portion, tight-fitness between the case body and the lid and hence moisture resistance of these known plastic cases is inevitably lowered, compared to the conventional regular cylindrical plastic case. To solve this problem, JPY No. 3-48581 suggests forming ribs integrally with the lid. However, such ribs may cause the lid to have sink marks in the engaging portion with the case body. Therefore, it is hard to obtain sufficient moisture resistance.

OBJECTS OF THE INVENTION

In view of the foregoing, a primary object of the invention is to provide a plastic case for a photographic film cassette, which has a horizontal contour other than a regular circle, but has sufficiently reliable moisture barrier characteristics.

Another object of the invention is to improve the plastic case with respect to space efficiency, smoothness in opening and closing the lid, efficiency and suitability in packing as well as in stacking, and also to lower the transportation cost.

SUMMARY OF THE INVENTION

To achieve the above and other objects in a plastic case consisting of a case body and a lid fitted to an open top of the case body, the present invention makes the case body have such a horizontal contour at least in its engaging portion with the lid, that is constituted of at least four arcs connected in series to one another, of which at least two arcs are different in radius from each other.

The above inventive construction improves the plastic case with respect to tight-fitness and hence moisture resistance. Also the space efficiency is improved by minimizing unoccupied spaces in the case body, which contributes to lowering the transportation cost.

According to a preferred embodiment, adjacent arcs have different radiuses from each other, wherein radius ratio Rl/Rs of a longer radius Rl to a shorter radius Rs of adjacent two arcs is not more than 10. All of the arcs preferably have radii of not less than 3 mm. In either of these constructions, the arcs are smoothly connected to each other.

It is also preferable to set the thickness of the rim of the lid to be in a range from 0.5 mm to 2 mm. According to this embodiment, the resin material can be fulfilled in the molds without fail when forming the lid by injection molding. Therefore, undesirable coloring of the resin materials is prevented, which may be caused by heat energy generated during the compression in those portions which contact the air staying in the mold. Thus, the quality of the molded product is improved.

BRIEF DESCRIPTION OF THE DRAWINGS

Other objects and advantages of the present invention will become apparent in the following detailed description of the preferred embodiments when read in connection with the accompanying drawings, wherein like reference numerals designates like or corresponding parts throughout the several views, and wherein.

DETAILED DESCRIPTION OF THE PREFERRED EMBODIMENT

Figure 1A:
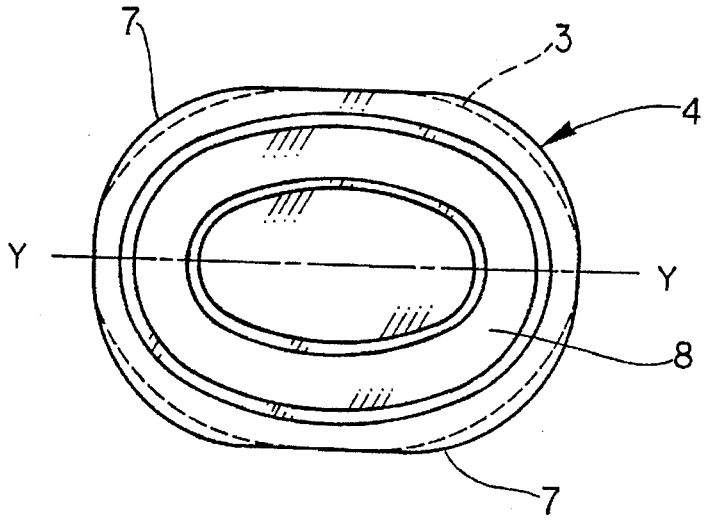
FIG. 1A is a top plan view of a plastic case for a photographic film cassette, according to a preferred embodiment of the invention.
Figure 1B:
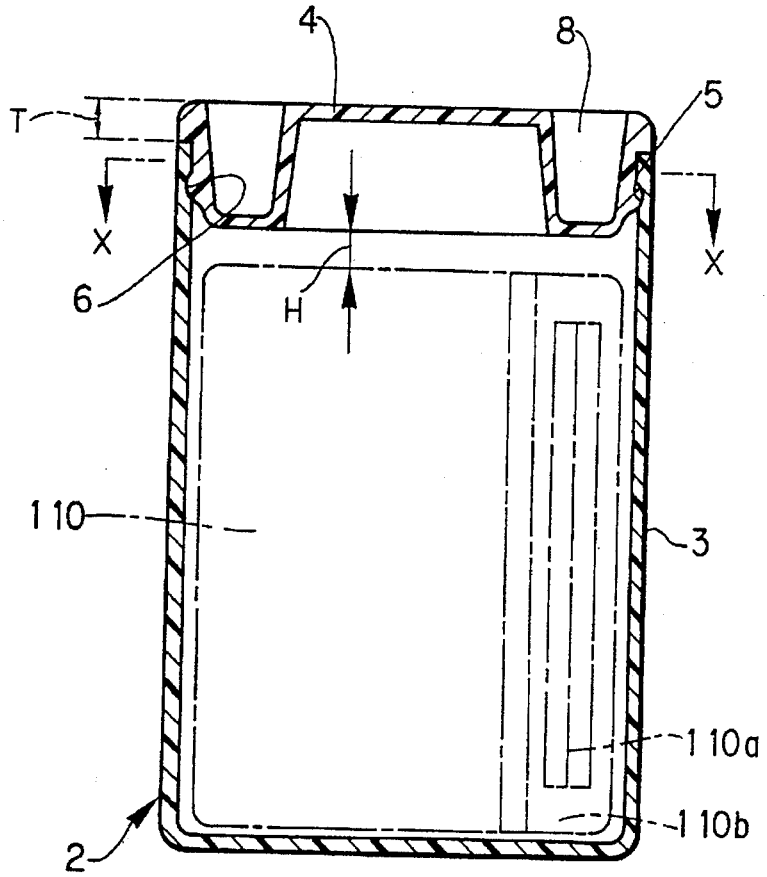
FIG 1B is a vertical sectional view of the plastic case according to the embodiment shown in FIG. 1A, taken along line Y—Y of FIG. 1A.

As shown in FIGS. 1A and 1B, a case 2 for a photographic film cassette 110 having a port portion 110*b* is constituted of a case body 3 and a lid 4. The case body 3 and the lid 4 are each formed from resin. The case body 3 is generally cylindrical and has a closed bottom and an open top for receiving the photographic film cassette 110 therein. The open top may be closed by the lid 4.

Figure 2:
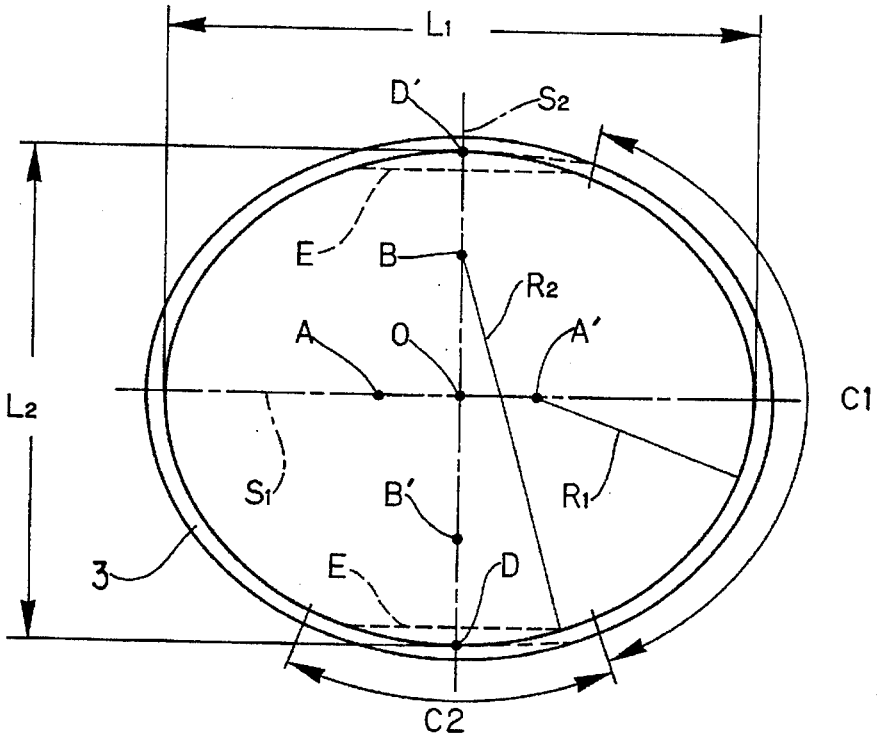
FIG. 2 is an explanatory view illustrating a horizontal contour of the case body of the plastic case according to the embodiment shown in FIGS. 1A and 1B.
Figure 3:
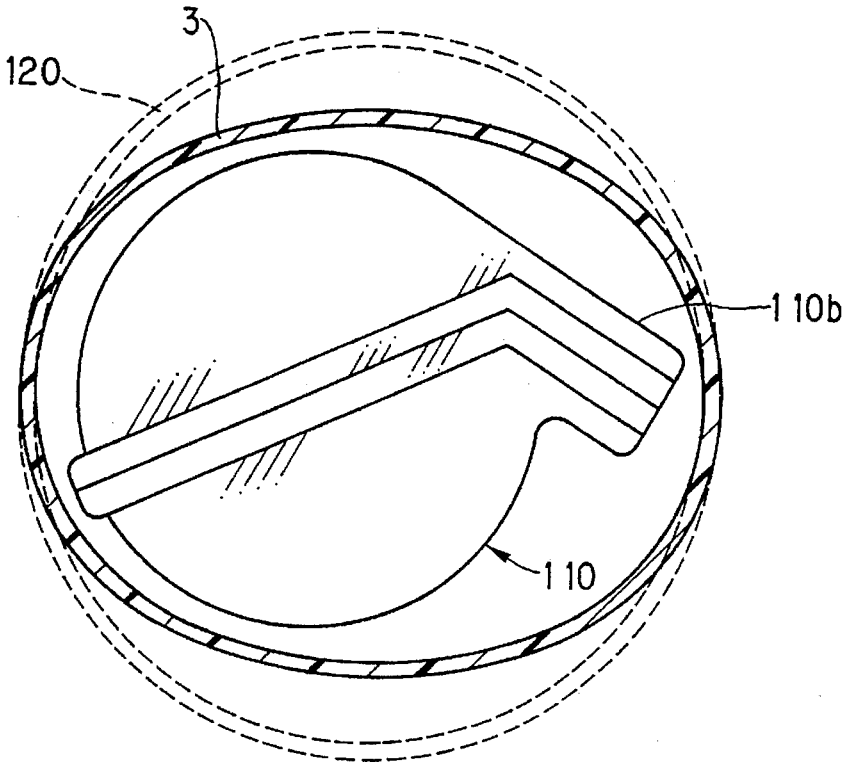
FIG. 3 is a horizontal sectional view of the case body, taken along line X—X of FIG. 1B, containing a photographic film cassette therein.

FIGS. 2 and 3 schematically show a horizontal section of the case body 3 taken on line X—X of FIG. 1B. According to a preferred embodiment of the invention, the horizontal contour of the case body 3 is constituted of a pair of arcs C1 with a radius R1 and another pair of arcs C2 with a larger radius R2 than the radius R1. The arcs C1 of one pair are continuous with the arcs C2 of the other pair to make an oval. According to the preferred embodiment, R1=12 mm and R2=20.5 mm, providing that the case body 3 has an internal diameter L1=32 mm in the lengthwise direction and an internal diameter L2=26 mm in the widthwise direction. The thickness of the side wall of the case body 3 is about 1 mm. FIG. 3 further shows the photographic film cassette 110 received in the case body 3. As shown in FIG. 3, unoccupied space is minimized as compared to a circular cross section case indicated by 12, and the photographic film cassette 110 is stably held in the plastic case 2 without being rotated therein.

If Rl and Rs represent a longer one and a shorter one of two different radii of two adjacent arcs in the irregular circle of the case body of the plastic case of the invention, it is preferable to determine the ratio Rl/Rs to be not more than 10, more preferably not more than 8, and most preferably not more than 5. If the radius ratio Rl/Rs is more than 10, the arc drawn with the longer radius would represent an approximately straight line E. Since the tightness-between the case body 3 and the lid 4 is diminished in such an almost straight portion, the moisture resistance of the plastic case 2 would be lowered at the ratio of Rl/Rs>10. In the embodiment shown in FIG. 2, the radius ratio Rl/Rs=R2/R1(=20.5 mm/12 mm)=1.71.

The above described shape of the horizontal contour of the case body 3 may be obtained in the following manner:

First, draw a pair of semi-circles with the radius R1=12 mm about two points A and A', respectively, which are disposed 8 mm apart from each other on a lengthwise axis S1. Next, draw a widthwise axis S2 across a center 0 between the points A and A' orthogonally to the lengthwise axis S1, and determine points D and D' on the widthwise axis S2 on opposite sides of the center 0, 13 mm therefrom in correspondence with the widthwise diameter L2=26 mm. Then, draw a pair of semi-circles with the radius R2=20.5 mm about two points B and B', respectively, which are disposed on the widthwise axis S2, 20.5 mm apart from the points D and D', respectively. Then, connect the four semi-circles to make a continuous curve.

Figure 4:
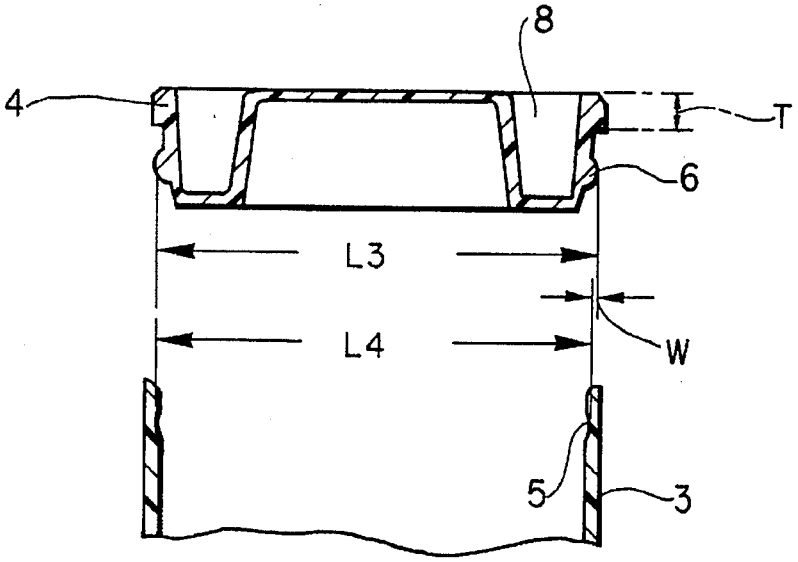
FIG. 4 is a vertical sectional view illustrating essential parts for engagement between the case body and the lid of the plastic case according to the embodiment shown in FIG. 1B.
Figure 5:
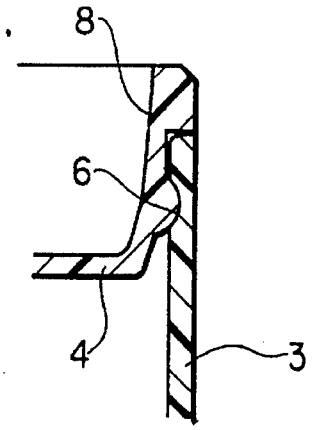
FIG. 5 is an enlarged vertical sectional view of the plastic case shown in FIG. 4, taken along line Y—Y of FIG. 1A.

As shown in FIGS. 1B, 4 and 5, a groove 5 is formed in the annular inner peripheral surface of the case body 3 near the open top thereof, whereas the lid 4 has a projection 6 annularly formed in correspondence with the groove 5. Since the projection 6 is engaged in the groove 5, the lid 4 is tightly fitted in the case body 3. According to the preferred embodiment, the depth of the groove 5 is 0.2 mm. Therefore, the diameters of the oval formed by the bottom of the annular groove 5 are 32.4 mm and 26.4 mm in the lengthwise and widthwise directions of the case body 3, respectively.

The diameters of the oval formed by the top of the projection 6 are 32.8 mm and 26.8 mm in the lengthwise and widthwise directions of the lid 4, respectively, which are slightly larger than the lengthwise and widthwise diameters 32.4 mm and 26.4 mm of the groove 5. Accordingly, as shown in FIG. 4, if L3 and L4 represent the maximum lengthwise diameters of the lid 4 and the case body 3, the top of the projection 6 protrudes radially outward from the bottom of the groove 5 by an amount W (=0.2 mm). Therefore, the projection 6 of the lid 4 is force-fitted in the groove 5 of the case body 3, and the lid 4 is tightly engaged with the case body 3 due to the resiliency of the case body 3 and the lid 4.

The amount W may be other than 0.2 mm, but should be larger than zero, preferably from 0.02 mm to 0.4 mm, more preferably from 0.05 mm to 0.3 mm. If the amount W is designed to be less than 0.02 mm, the actual amount W may be less than zero in some places due to variation of tolerance in molding. If the amount W is designed to be more than 0.4 mm, it would be difficult to reliably form the lid 4 because the lid 4 would require a great deal of force to be removed from the mold and the lid 4 might be broken. With that large amount W, the lid 4 would also be hard to remove from the case body 3.

Figure 6:
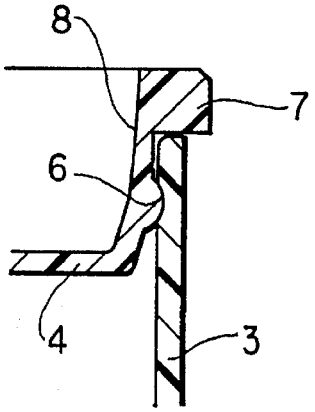
FIG. 6 is a view similar to FIG. 5, but showing the engaging portion of the case wherein the lid has a flange for enabling the lid to be caught with the fingers.

As shown in FIG. 1A and 6, the lid 4 has flanges 7 on the upper portion thereof which protrude about 0.5 mm to 2.5 mm radially outward from the outer periphery of the case body 3 when the lid 4 is fitted in the case body 3, so as to permit the fingers of a user to catch the lid 4 so as to facilitate removal of the lid 4 from the case body 3. It may be possible to form such flange around the circumference of the lid 4, but it is preferable to form the flanges 7 in the manner as shown in FIG. 1A. That is, crescent-shaped flanges 7 are formed between the top portions of the adjacent arcs C1 and C2. According to this construction, the external volume of the plastic case 2 can be small, so that the volume of a box for packaging the plastic case 2 can also be small. It is to be noted that FIG. 5 shows an enlarged vertical section of the lid 4 and the case body 3 taken along a portion having no flange 7, as a comparison with FIG. 6.

As shown in FIG. 4, the lid 4 is formed with a recess 8 which is annular. The recess 8 facilitates elastic bending of the lid 4 which is required when fitting and removing the lid 4 into and out of the case body 3.

There is provided a small gap H between the bottom of the lid 4 and the top of the photographic film cassette 110 encased in the plastic case 2, as is shown in FIG. 1B. It would be preferable to minimize the gap H in view of the space efficiency of the plastic case 2. However, if the gap H is designed to be less than 0.05 mm, the lid 4 cannot sometimes be fitted in the case body 3 because of variation of tolerance in forming and/or assembling the case. Accordingly, it is preferable to design the gap H to be not less than 0.05 mm.

In order to permit insertion of the photographic film cassette 110 into the plastic case 2, a certain gap or play is necessary between the outer periphery of the cassette 110 and the inner periphery of the case body 3. However, if the play is too large, the photographic film cassette 110 would be so unstable in the plastic case 2 that the cassette 110 would knock the plastic case 2 and may scratch the inner wall of the case. In a worst case, the photographic film cassette 110 or the plastic case 2 would be cracked. For this reason, it is preferable to minimize the play between the plastic case 2 and the cassette 110. The minimum play, that is, the play between the tip of the port portion 110*b* and the inner wall of the case body 3 should preferably be from 0.1 mm to 2.0 mm. In order to hold the photographic film cassette 110 stably in the plastic case 2 while facilitating insertion of the cassette 110 into the plastic case 2, it is also preferable to make the diameter of the open top of the case body larger than that of the bottom, or to form a plurality of ribs on the inner wall of the case, or to stuff any void with a buffer material such as sponge.

Figure 7:
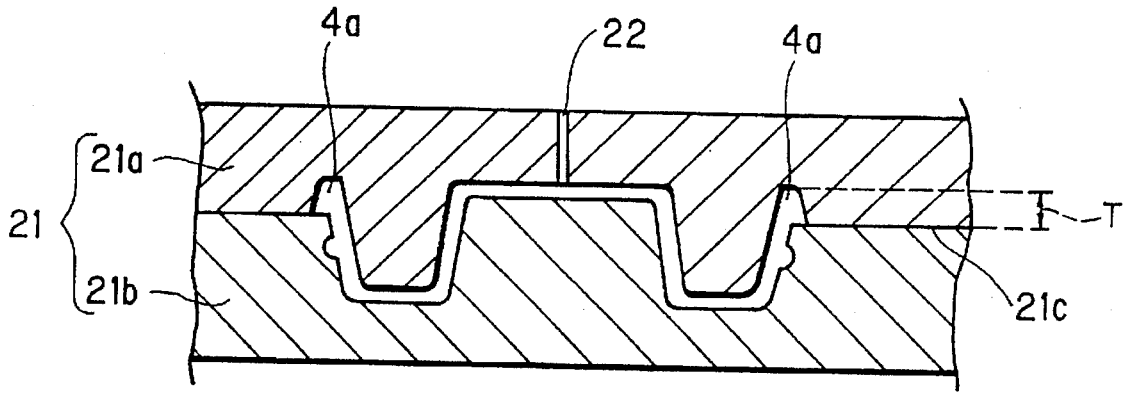
FIG. 7 is a sectional view of molds for forming the lid.
Figure 8:
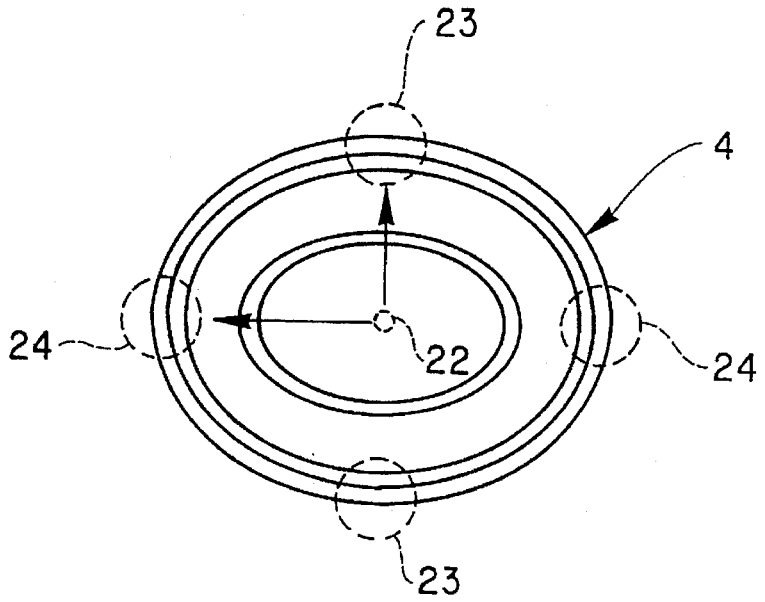
FIG. 8 is an explanatory view illustrating the flow of resin material in the molds shown in FIG. 7.

The lid 4 is formed from plastic resin by injection molding. As shown in FIG. 7, molds 21 for the lid 4 are constituted of upper and lower molds 21*a* and 21*b*. The resin is injected into the molds 21 through a gate 22 provided in a center of the molds 21, and spreads radially outward. At that time, because the length from the gate 22 to the ends 23 of the lid 4 in the widthwise direction is shorter than the length from the gate 22 to the ends 24 in the lengthwise direction, the resin reaches the shorter ends 23 faster than the longer ends 24, so that the resin flows from the shorter end 23 toward the longer ends 24 along the circumference of the lid 4. Thereby, air in the molds 21 is pushed by the resin toward the longer ends 24, and is discharged out of the molds 21 through small gaps provided between the upper and lower molds 21*a* and 21*b* along parting lines 21*c*. If the thickness T of the rim 4*a* of the lid 4 is too large, the air gathered in the longer ends 24 tends to stay in the upper portion of the longer end 24. If the air remains in the molds 21, the portion of the resin that contacts the air would be undesirably colored due to heat energy radiated while the resin is being compressed. For this reason, it is preferable to design the thickness T of the rim 4*a* of the lid 4 to be not more than 2 mm, more preferably not more than 1.7 mm, and most preferably not more than 1.5 mm. However, with the thickness T of less than 0.5 mm, it becomes difficult for a person to reliably catch the flange 7 with their fingers so as to remove the lid 4. Accordingly, the thickness T should preferably be not less than 0.5 mm, and more preferably not less than 0.8 mm.

Figure 9:
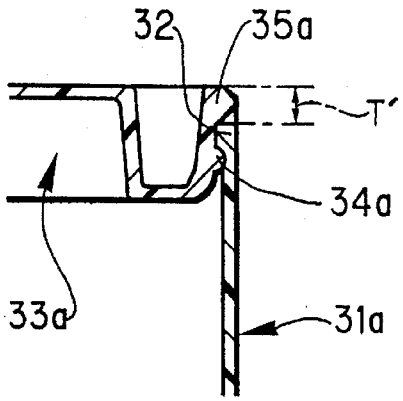
FIG. 9 is a view similar to FIG. 5, but showing a modification of the engaging portions between the lid and the case body.
Figure 10:
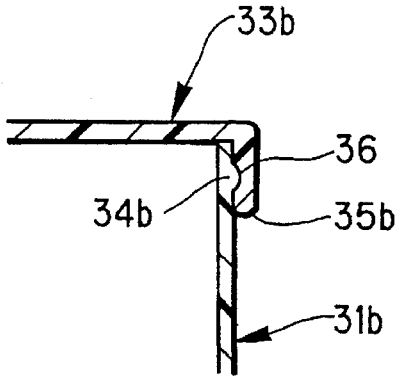
FIG. 10 is a view similar to FIG. 5, but showing another modification of the engaging portions between the lid of the case body.
Figure 11:
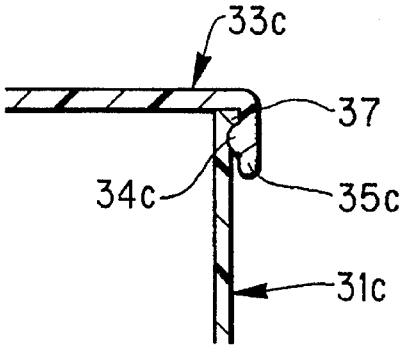
FIG. 11 is a view similar to FIG. 5, but showing a further modification of the engaging portions between the lid and the case body.

The engaging construction between the case body 3 and the lid 4 may be modified as shown in FIGS. 9, 10 or 11. In the modification shown in FIG. 9, at least an inward projection 32 is formed around the brim of the open top of a case body 31*a*, so that a projection 34*a* of a lid 33*a* passes over the projection 32 to secure the lid 33*a* to the case body 31*a*. Also in this embodiment, since the rim 35*a* of the lid 33*a* is disposed at the top, it is preferable to dimension the thickness T' of the rim 35*a* in a range from 0.5 mm to 2 mm, for reliable filling of resin in molding.

It is also preferable to provide knurls on the periphery of the flanges for facilitating removal of the lid.

In the modification shown in FIG. 10, a lid 33*b* has an annular flange which covers the rim of the open top of a case body 31*b* when the lid 33*b* is attached to the case body 31*b*. In this modification, the lid 33*b* has a groove 36 formed around the inner periphery of the flange, while the case body 31*b* has a projection 34*b* formed around the outer periphery of the rim. Also in the modification shown in FIG. 11, a lid 33*c* is fitted on a case body 31*c* so as to cover the rim of the open top of the case body 31*c* with an annular flange of the lid 33*c*. But, the case body 31*c* has an outward projection 37 formed on the rim of the open top, and the lid 33*c* has a projection 34*c* formed around the inner periphery of the flange, which passes over the projection 37 of the case body 31*c* to secure the lid 33*c* to the case body 31*c*. In case the lid has a flange which covers the rim of the case body, the size of the oval formed by the top of the projection 36 or 37 should be slightly larger than the size of the oval horizontal contour at the bottom of the groove 36 or at the top of the projection 34*c*. Since the rims 35*b* and 35*c* of the lids 33*b* and 33*c* are disposed below the top surface of the lids 33*b* and 33*c*, it is unnecessary to definitely determine the thickness of the rims 35*b* and 35*c*.

Figure 12:
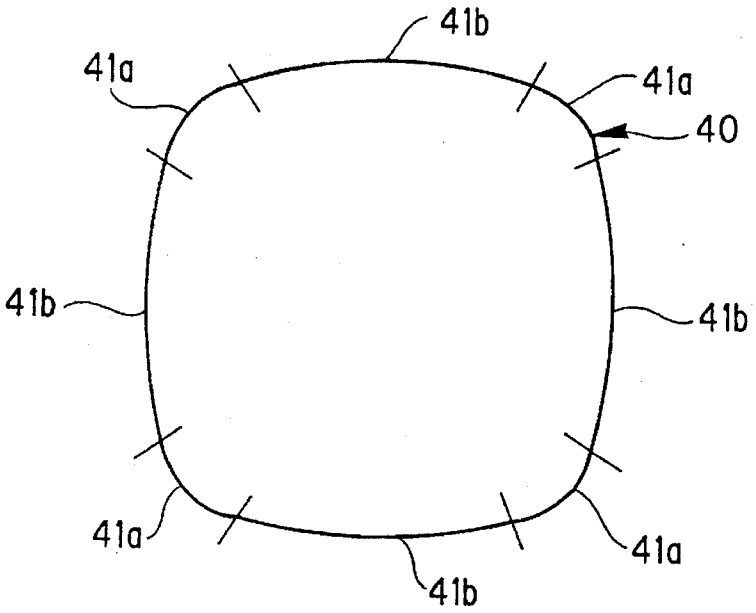
FIG. 12 is an explanatory view illustrating a horizontal contour of a case according to another embodiment of the invention.

Although the embodiment shown in FIG. 2 is constituted of two pairs of arcs of different radiuses R1 and R2, the two arcs of each pair being opposed to each other, the present invention is not limited to this embodiment, but various embodiments are possible as long as the radius ratio Rl/Rs of two adjacent arcs is not more than 10. For example, as shown in FIG. 12, a case 40 for a photographic film cassette may have a horizontal contour constituted of eight arcs, of which four arcs 41*a* are drawn with a first radius and other four arcs 41*b* are drawn with a second radius, and the two kinds of arcs 41*a* and 41*b* are alternately connected to form a continuous curve. It is not always necessary to dispose those arcs which have the same radius in opposition to each other. It is also unnecessary to use an even number of arcs. However, using more than eight arcs complicates the shape of the molds required.

The resin for forming the plastic case 2 according to the present invention should be a thermoplastic resin including olefin polymer such as polystyrene polyethylene, that is, high density polyethylene (HDPE), middle density polyethylene (MDPE), low density polyethylene (LDPE) or a mixture thereof, polypropylene (block copolymer, random copolymer, single polymer or a mixture thereof), and polyester resins such as polybutylene-terephthalate.

In order to prevent deformation due to external stress, it is preferable to use a material of high stiffness for forming the case body 3. For forming the lid 4, a material of lower stiffness is preferable for obtaining a high moisture resistance and facilitating opening and closing of the lid 4. The resin for forming the case body 3 preferably has a modulus in flexure of not less than 3000 kg/cm$^2$, more preferably not less than 6000 kg/cm$^2$ and most preferably not less than 8000 kg/cm$^2$. The resin for forming the lid 4 preferably has a modulus in flexure of not less than 800 kg/cm$^2$, more preferably not less than 1000 kg/cm$^2$, and most preferably not less than 1200 kg/cm$^2$. A preferable combination of the resin materials for the case body 3 and the lid 4 is polypropylene or high density polyethylene for the case body 3 and low density polyethylene for the lid 4.

The fluidity of the resin for the case body 3 should be not less than 7 in MI (melt index) or MFR (melt flow rate), preferably not less than 10, and more preferably not less than 15. The MI or MFR of the resin for the lid 4 should be not less than 5, preferably not less than 8, and more preferably not less than 12. The resin for the case body 3 should not be less than 7 in MI or MFR, and the resin f or the lid 4 should not be less than 5 in MI or MFR. This is because the resin could not smoothly flow and hence a short shot may frequently occur during molding under those MI or MFR values.

It is preferable to add various admixtures to the resins for forming the case body 3 and the lid 4. That is, antioxidant is used for preventing oxidation of the resins that could be caused by a high temperature during the molding. Lubricants are used for improving the moldability and the smoothness for insertion of the photographic film cassette 110 into the plastic case 2 as well. Nucleating agent is used for promoting crystallization, shortening the molding cycle time, improving the stiffness or preventing deformation, and improving physical strength. Light screens or X-ray shielding materials are used for protecting the encased photographic film cassette 110 from ambient light or X-rays.

The antioxidant includes free radical chain terminators which react on and inactivate free radicals (mainly ROO—) that act as chain transfer agents in oxidation, and peroxide decomposers which decompose and stabilize hydroperoxide (ROOH) which is the main generator of the free radicals. The former includes phenolic antioxidant and aromatic amine antioxidant. The later includes sulfuric antioxidant and phosphoric antioxidant. For these reasons, it is preferable to use phenolic antioxidant and phosphoric antioxidant in combination in the present invention.

Because the antioxidant of various types are reducing agents which adversely affect photographic materials, loading of the antioxidant is an important factor. The preferable loading of the mixture of phenolic and phosphoric antioxidant is from 0.001 to 2.0 wt % (weight percent), more preferably from 0.01 to 0.5 wt %, and most preferably from 0.03 to 0.3 wt %. A loading of less than 0.001 wt % has little antioxidizing effect, but merely increase the mixing and milling cost. A loading of more than 2.0 wt % of antioxidant would yield undesirable affects such as fogging or disordering of sensitivity on the photographic film, because the photographic film utilizes oxidizing and reducing effects for photographic recording.

As lubricants, which are loaded for improving the resin in moldability and increasing smoothness of the plastic case 2 on inserting the photographic film cassette 110, the following lubricants may be useful: saturated fatty acid amid lubricants such as behenic acid amid, stearic acid amid and palmitic acid amid; unsaturated fatty acid amid lubricants such as erucamide and oleamide; bis fatty acid amid lubricants such as methylene bisphenic amid, methylene bis-stearic acid amid, methylene bisoleic acid amid, ethylene bis-stearic acid amid, hexamethylene bis-stearic acid amid and hexamethylene bisoleic acid amid; silicone lubricant such as dimethyl polysiloxane and its modification; nonionic surface active agent lubricants; hydrocarbon lubricants such as liquid paraffin, natural paraffin, micro-wax, synthetic paraffin, polyethylene wax, polypropylene wax, chlorinated hydrocarbon and fluorocarbon; fatty acid lubricants such as high fatty acid (preferably C12 or more); ester lubricants such as lower alcohol ester of fatty acid and polyglycol ester of fatty acid; alcohol lubricants such as polyhydroxy alcohol, polyglycol and polyglycerol; and metallic soaps such as compounds of metal including Li, Mg, Ca, Sr, Ba, Zn, Cd, Al, Sn and Pb with higher fatty acid including lauric acid, stearic acid, ricinoleic acid, naphthenic acid and oleic acid. It is possible to use a single one of these lubricants or a combination of more than one of these lubricants.

A preferable loading of the lubricants is from 0.01 to 5.0 wt %. Loading of less than 0.01 wt % has little lubricating effect, but merely increases the mixing and milling cost. Loading of more than 5.0 wt % may cause bleed-out or slipping of screws, increases in the frequency of molding errors and lower milling quality, because the resin emission amount would fluctuate with too much lubricants. In the case of fatty acid amid lubricants, which are inexpensive, do not have adverse influences such as fogging and disordering of sensitivity on the photographic film, and are effective in increasing the smoothness and shortening the molding cycle time, the loading is preferably from 0.01 to 3.0 wt %, and most preferably from 0.02 to 1.0 wt %, in the interest of prevention of molding error and bleed-out and so forth. In the case of hydrocarbon lubricants or metallic soaps, which have less smoothing effects but contribute to improving upon dispersing quality of various admixtures and thus fluidity of the resin, it is possible to load them up to 20 wt % as long as no problems occur.

A nucleating agent is added for speeding crystallizing and molding, improving stiffness, transparency, physical strength, and for preventing deformation. There are organic nucleating agents and inorganic nucleating agents. Representative examples of these nucleating agents are as follows:

Organic nucleating agents are carboxylic acid, dicarboxylic acid, salts and anhydride of these materials, salts and ester of aromatic sulfonic acid, aromatic phosphinic acid, aromatic phosphonic acid, aromatic carbonic acid and aluminum salts thereof, metallic salts of aromatic phosphoric acid, alkyl alcohol of C8 to C30, condensate of polyhydroxy alcohol and aldehyde, as well as alkyl amine, and include, for example, p-t-butyl-benzoic acid aluminum, 1,3.2,4-dibenzyliden sorbitol, di-substituted-dibenzyliden sorbitol compound, metallic salts such as calcium or magnesium salt of stearyl lactic acid, N-(2-hydroxyethyl) -stearyl amine, metallic salts such as lithium salt, sodium salt, potassium salt, calcium salt or magnesium salt of 1.2-hydroxy stearic acid, alkyl alcohol such as stearyl alcohol and lauric alcohol, benzoic soda, benzoic acid, and sebacic acid.

Inorganic nucleating agents are alkali metal hydroxide such as lithium hydroxide, sodium hydroxide and potassium hydroxide, alkali metal oxide such as sodium oxide, alkali metal carbonate such as lithium carbonate, sodium carbonate, potassium carbonate, sodium bicarbonate and potassium bicarbonate, alkali earth metal hydroxide such as calcium hydroxide, magnesium hydroxide and barium hydroxide, and alkali earth metal oxide such as calcium carbonate and calcium oxide.

Nucleating agents are not limited to the above examples, but other known nucleating agents may be applicable of course, two or more nucleating agents may be added to the resin. Loading of the nucleating agent is from 0.01 to 2.0 wt %, preferably from 0.05 to 11.0 wt %. Loading of less than 0.01 wt % has little effect. On the other hand, the nucleating effect would not increase beyond the loading of 2.0 wt %, but the cost would increase.

As a light screen agent, which is used for protecting the photographic film cassette from ambient light, there are carbon black, graphite, aluminum powder, aluminum flakes, titanium oxide, calcium sulfate, barium sulfate, talc, clay, mica, stainless steal powder, starch, tin powder, pearlescent pigment, zinc oxide, potassium titanate, glass beads and so forth. These light screen agents may be used individually or in combination with each other, or in combination with dye. The above light screen agents may be subjected to some surface treatment. A preferable loading of the light screen is 0.01 to 30 wt %. Loading of less than 0.01 wt % would have almost no light shielding effect, but merely increase the milling cost.

In order to provide the plastic case 2 with an X-ray shielding property, at least one of barium compound, zinc or zinc compound, tin or tin compound, and lead or lead compound is loaded in the resin material at 10 to 50 wt %. However, appearance and drop impact strength are lowered by the loading of such a material unless the plastic case 2 has a sufficient thickness.

The above-described plastic case 2 for a photographic film cassette is required to have moisture resistance or moisture barrier characteristics of not more than 20 mg/24 hours, preferably not more than 15 mg/24 hours, more preferably not more than 10 mg/24 hours, and most preferably 5 mg/24 hours, although these values may be varied, depending on the kind of the photographic film to be encased therein. In order to measure the moisture barrier characteristics, the weight of the plastic case 2 containing about 5 g of hygroscopic agent such as potassium chloride is measured before and after leaving the same for 24 hours under temperature of 40° C. and humidity of 90% RH.

To confirm the superior moisture barrier characteristics of the plastic case according to the present invention, ten pieces of plastic cases each having an oblong horizontal contour consisting of a pair of arcs C1 (with radius of 12 mm) and a pair of straight portions E as shown by dashed lines in FIG-2, were formed as comparisons. These ten pieces of comparisons and ten pieces of plastic cases formed according to the present invention were subjected to the above-described moisture resistance test. The overlapping amount in the engaging portion between the case body and the lid of the comparison, that corresponds to the amount W in FIG. 4, was set at 0.2 mm as in the above-described embodiment.

Based on the results of the moisture resistance test, it was determined that moisture permeability of the plastic case according to the present invention is 1 to 2 mg/24 hours, while that of the comparative samples is 13 to 31 mg/24 hours. Consequently, the plastic case according to the present invention has remarkably high moisture resistance.

Figure 16:
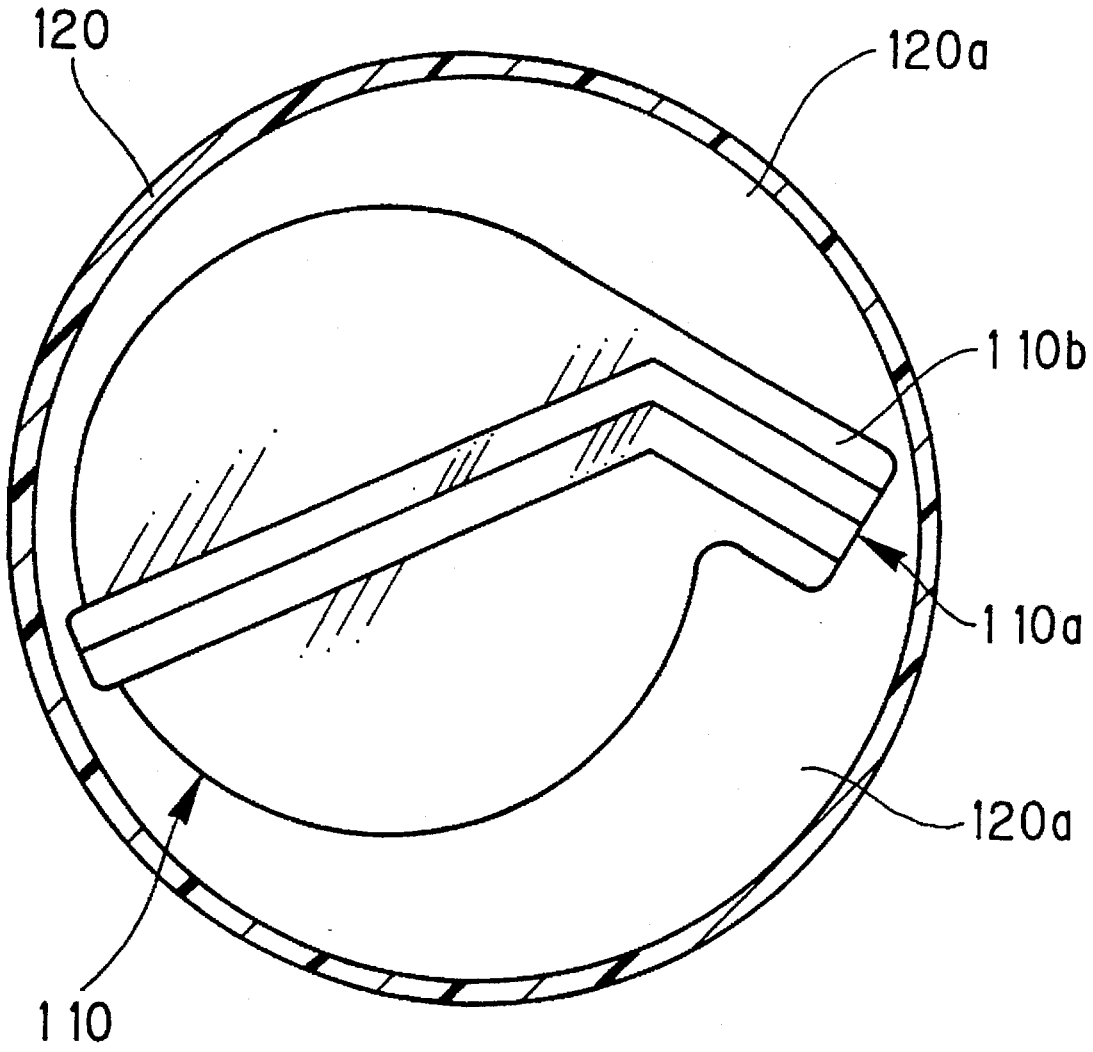
FIG.16 (PRIOR ART)
FIG. 16 is a horizontal sectional view of a case body of a conventional plastic case, containing the photographic film cassette shown in FIG. 3.

In addition to the above-described oblong shaped comparative plastic case, two kinds of plastic cases having a square horizontal contour and a regular circular horizontal contour such as shown in FIG. 16, respectively, were made as comparative samples to be compared with the plastic case having the above-described oval horizontal contour of the present invention. These samples were tested with respect to space efficiency, moisture resistance (inclusive of variation of tolerance), suitability for automated packing, that is, whether it is necessary to adjust rotational angle of the photographic film cassette 110 to the plastic case when dropping the cassette 110 into the case body, and transport cost and stability in stacking after the plastic cases are packed in rectangular cardboard boxes.

The results are shown in Table 1, wherein evaluation of each item is classified into three grades: very good (G), needs improvement (N) and bad (B). As for the space efficiency and the transport cost, figures in parentheses represent relative values provided that the space efficiency and the transport cost of the case having a square horizontal contour are "1".

TABLE 1

| | SQUARE | REGULAR CIRCLE | OBLONG CIRCLE | EMBODIMENT OF THE INVENTION |
|---|---|---|---|---|
| VOLUME | B(1) | N(0.67) | G(0.55) | G(0.57) |
| STABILITY IN STACKING | N | N | G | |
| SUITABILITY FOR AUTOMATION | N | G | N | N |
| MOISTURE RESISTANCE | B | G | N or B | G |
| TRANSPORT COST | B(1) | N(0.67) | G(0.55) | G(0.57) |

Figure 13:
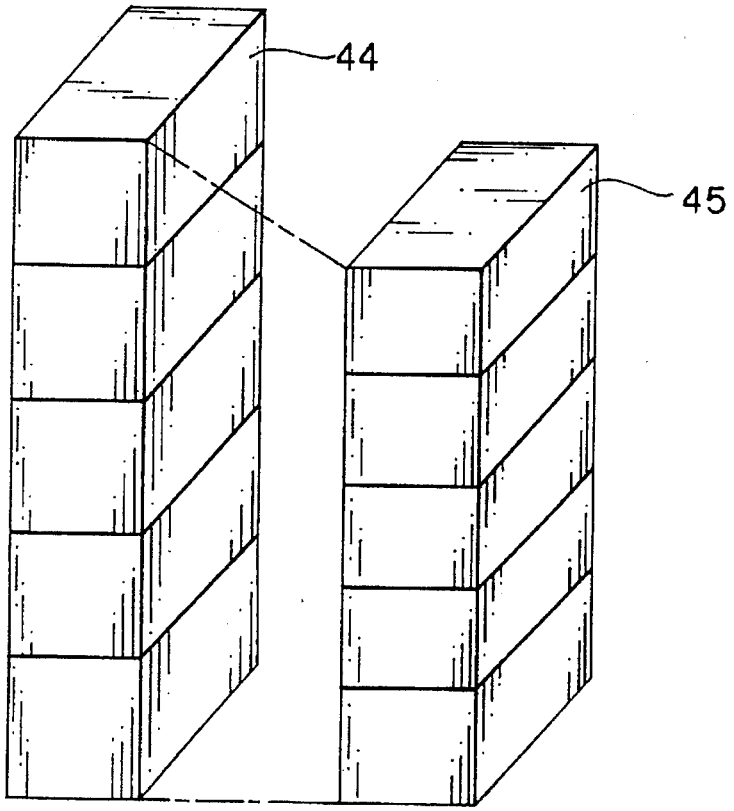
FIG. 13 is an explanatory view illustrating a stack of rectangular boxes for packing the plastic case according to the invention, in comparison with another stack of rectangular boxes for packing conventional plastic case.

As seen from Table 1, the plastic case according to the present invention is superior to the comparative samples in moisture resistance and space efficiency. Therefore, the transportation cost can be lowered. Moreover, as shown in FIG. 13, a rectangular box 45 for packing the plastic case 2 according to the invention may have a smaller internal volume than a rectangular box 44 for packing the conventional plastic case 120. Accordingly, the case according to the present invention is also superior to the conventional ones in the stability in stacking when the same number of these rectangular boxes are stacked on top of another.

Figure 14:
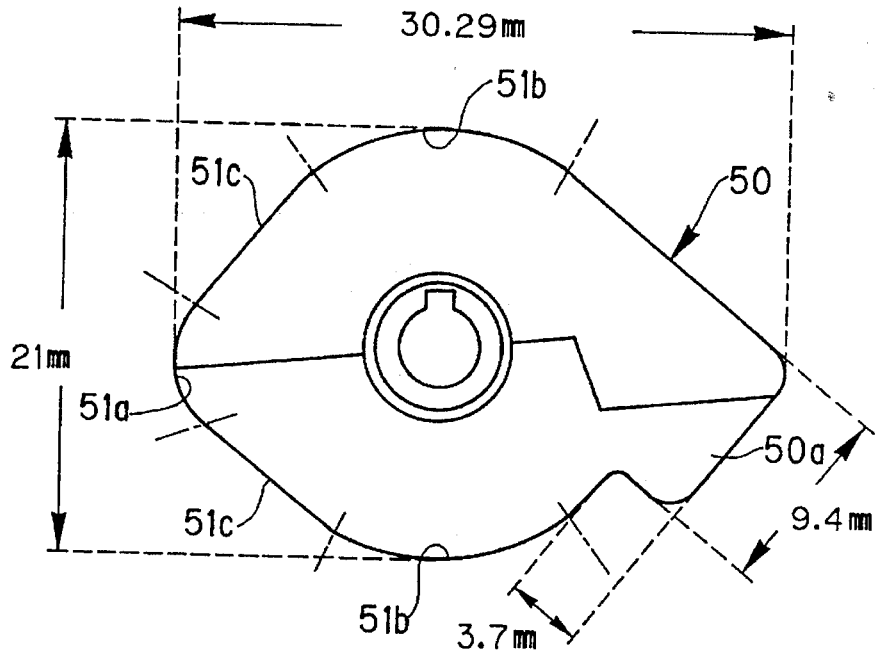
FIG. 14 is an explanatory view illustrating a horizontal contour of a photographic film cassette.

In order to evaluate the space efficiency of the rectangular box for packing the inventive plastic case, a plurality of inventive plastic cases and rectangular boxes therefor, as well as comparative cases having a regular circular horizontal contour and rectangular boxes therefor were made to contain the same kind of photographic film cassette 50 as shown in FIG. 14. Both the inventive and comparative plastic cases were made to have a play of not less than 0.5 mm around the periphery of the photographic film cassette 50. The rectangular boxes were made to have a play of about 0.25 mm around the periphery of the related plastic case.

The photographic film cassette 50 has a horizontal contour of an irregular shape which is mainly formed by an arc 51*a* of 4 mm radius, arcs 51*b* of 10.5 mm radius and straight portions 51*c* connecting these arcs to each other, and has a port portion 50*a* protruding 3.7 mm from the adjacent peripheral surface. In total, the irregular shape is 30.29 mm by 21 mm in diameter. It is preferable to determine the radii of the two kinds of arcs 51*a* and 51*b*, which substantially determine the lengthwise and widthwise diameters of the photographic film cassette 50 within a range of ±20% around the above-mentioned values, respectively. It is more preferable to determine the radiuses within a range of ±10%, and most preferably within a range of ±5% around the above-mentioned values, respectively. If the radii of the arcs 51*a* and 51*b* differ more than 20% from the above-mentioned values, it will be difficult to make the photographic film cassette have a streamlined contour.

Figure 15:
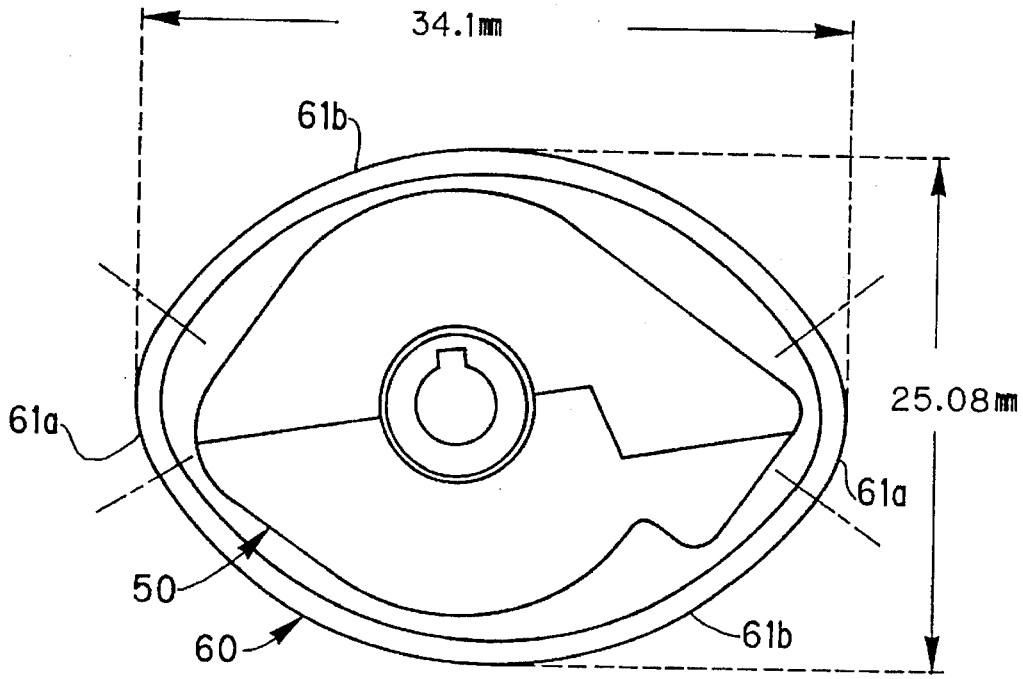
FIG. 15 is an explanatory view illustrating a horizontal contour of a case body of a plastic case according to an embodiment of the invention, for containing the photographic film cassette shown in FIG. 14.

FIG. 15 schematically illustrates a horizontal contour of a preferred embodiment of the plastic case 60 for containing the film cassette 50. The outer periphery of the plastic case 60 is formed by a pair of arcs 61*a* of 6.55 mm radius and a pair of arcs 61*b* of 18.75 mm radius, such that the two arcs of each pair are opposed to each other, and that the arcs 61*a* and 61*b* are connected to each other. The plastic case 60 is 34.1 mm by 5.08 mm in diameter, and the peripheral wall is about 1 mm thick. Consequently, the radius ratio Rl/Rs of the arc 61*b* to the arc 61*a* is 2.86.

Table 2 shows the results of evaluation of external dimensions and internal volume of the two kinds of rectangular boxes for packing the inventive plastic case 60 and the comparative plastic case. Also the ratio of volume of the box for the plastic case 60 to that of the box for the comparative case is figured in Table 2.

TABLE 2

| | REGULAR CIRCLE | EMBODIMENT OF THE INVENTION |
|---|---|---|
| HEIGHT | 33.89 | 26.08 |
| WIDTH | 33.89 | 35.10 |
| LENGTH | 49.00 | 49.00 |
| VOLUME | 56278 | 44855 |
| VOLUME RATIO | 1.000 | 0.797 |

As can be seen from Table 2, the internal volume of the rectangular box for the inventive plastic case 60 can be remarkably small in comparison with the rectangular box for he conventional plastic case having a regular circular horizontal contour. Therefore, the total size of the box can be smaller than a conventional box. Since the box for the plastic case 60 is smaller in height and larger in width compared to the conventional box, when stacked in a manner as shown in FIG. 13, the box for the plastic case 60 has improved stability in stacking, compared to the conventional box, such as the box 44.

What is claimed is:

1. A photographic film cassette package including a case and a photographic film cassette contained in said case, said photographic film cassette containing a roll of photographic film in a cassette shell, said case consisting of a case body injection molded from resin having a closed bottom and an open top and a lid injection molded from resin to be fitted to said open top of said case body, wherein:

said case body has an engaging portion formed proximate said open top, said engaging portion being adapted to be engaged with said lid, said case body has a horizontal contour, at least at said engaging portion, that is constituted of at least four arcs connected in series to one another, at least two of said arcs are different in radius from each other, said horizontal contour being devoid of straight portions, wherein adjacent two of said arcs are different in radius from each other and wherein a radius ratio Rl/Rs of a longer radius Rl to a shorter radius Rs of adjacent two arcs is not more than 5, said lid overlapping said case body in a radial direction of said case body by an amount W which is in the range of 0.02 mm to 0.4 mm inclusive.

2. A plastic case as claimed in claim 1 wherein said lid is fitted to said engaging portion to define a seal between said lid and said case body, said seal having a moisture barrier characteristic of not more than 10 mg/24 hours at a temperature of 40° C. and a humidity of 90% RH.

3. A plastic case as recited in claim 2, wherein said moisture barrier characteristic is not more than 5 mg/24 hours at a temperature of 40° C. and a humidity of 90% RH.

4. A plastic case as claimed in claim 1, wherein two of said arcs which are opposed to each other are equal in radius.

5. A plastic case as claimed in claim 1, wherein all of said arcs are provided with radii of not less than 3 mm.

6. A plastic case as claimed in claim 1, wherein said lid has crescent-shaped flanges which extend radially outward from an outermost periphery of said case body when said lid is fitted to said engaging portion of said case body, said crescent-shaped flanges being disposed between top portions of two of said arcs that are adjacent to one another.

7. A plastic case as claimed in claim 6, wherein said lid has a rim including said flanges, said rim having a thickness in a range from 0.5 mm to 2 mm.

8. A plastic case as claimed in claim 1, wherein said lid has an annular flange which extends axially from a top of said lid to cover an outermost periphery of said open top of said case body.

9. A plastic case as claimed in claim 1, wherein said engaging portion has one of a groove in which a projection of said lid is force fitted and a projection on which one of a groove of said lid is force fitted and a projection of said lid is hooked.

10. A plastic case as claimed in claim 1, wherein said lid and said case body are formed from thermoplastic resin including one of polyolefin resin and polyester resin.

11. A plastic case as claimed in claim 10, wherein said case body is formed from one of polypropylene and high density polyethylene, and said lid is formed from low density polyethylene.

12. A plastic case for a photographic film cassette, consisting of a case body having a closed bottom and an open top, and a lid to be fitted to said open top of said case body, wherein:

said case body has an engaging portion formed proximate said open top, said engaging portion being adapted to be engaged with said lid, said case body has a horizontal contour, at least at said engaging portion, that is constituted of at least four arcs connected in series to one another, at least two of said arcs are different in radius from each other, said horizontal contour being devoid of straight portions, wherein all of said arcs are provided with radii of not less than 3 mm.

* * * * *